US008439483B2

(12) United States Patent
Kihara et al.

(10) Patent No.: US 8,439,483 B2
(45) Date of Patent: May 14, 2013

(54) LIQUID EJECTION HEAD AND METHOD OF PRODUCING THE SAME

(75) Inventors: Hiroki Kihara, Sagamihara (JP); Tadayoshi Inamoto, Hachioji (JP); Isao Imamura, Kawasaki (JP); Yoshihiro Hamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 207 days.

(21) Appl. No.: 13/082,695

(22) Filed: Apr. 8, 2011

(65) Prior Publication Data

US 2011/0279546 A1 Nov. 17, 2011

(30) Foreign Application Priority Data

May 12, 2010 (JP) ..... 2010-110103

(51) Int. Cl.
*B41J 2/14* (2006.01)

(52) U.S. Cl.
USPC ..... 347/50; 347/58

(58) Field of Classification Search ..... 347/50, 347/58
See application file for complete search history.

(56) References Cited

U.S. PATENT DOCUMENTS

| | | | |
|---|---|---|---|
| 7,425,057 | B2 | 9/2008 | Harada et al. |
| 7,600,857 | B2 | 10/2009 | Kihara et al. |
| 7,722,917 | B2 | 5/2010 | Shimomura et al. |
| 7,931,352 | B2 | 4/2011 | Imamura et al. |
| 2009/0128602 | A1 | 5/2009 | Goto et al. |
| 2009/0141085 | A1 | 6/2009 | Kihara et al. |
| 2009/0315948 | A1 | 12/2009 | Imamura et al. |
| 2010/0196590 | A1 | 8/2010 | Shimomura et al. |

FOREIGN PATENT DOCUMENTS

| | | | |
|---|---|---|---|
| JP | 11-348290 | A | 12/1999 |
| JP | 2004-351754 | A | 12/2004 |

*Primary Examiner* — Matthew Luu
*Assistant Examiner* — Henok Legesse
(74) *Attorney, Agent, or Firm* — Fitzpatrick, Cella, Harper & Scinto

(57) ABSTRACT

A liquid ejection head includes a chip having a liquid ejection pressure generating element and an electrode terminal for electrically connecting the liquid ejection pressure generating element to an external source, an electrical wiring board having a lead wiring to be electrically connected to the electrode terminal, and a lead sealing material for covering an electrical connection portion between the electrode terminal and the lead wiring. The lead sealing material contains an epoxy resin which has an average number of functional groups per molecule of more than two and is solid at 25° C., an acid anhydride curing agent having a polybutadiene backbone, a curing accelerator, and an inorganic filler.

5 Claims, 3 Drawing Sheets

LIQUID EJECTION HEAD AND METHOD OF PRODUCING THE SAME

BACKGROUND OF THE INVENTION

1. Field of the Invention

The present invention relates to a liquid ejection head that ejects a liquid and a method of producing the liquid ejection head, in particular, an ink jet recording head that ejects ink onto a recording medium to perform recording and a method of producing the ink jet recording head.

2. Description of the Related Art

Liquid ejection heads that eject liquids are specifically exemplified by ink jet recording heads each of which is applied to an ink jet recording system according to which ink is ejected onto a recording medium so that recording is performed.

Japanese Patent Application Laid-Open No. 2004-351754 has the following description concerning the production of an ink jet recording head. First, the top of a silicon substrate is provided with multiple ejection pressure generating elements and electrode terminals for electrically connecting the elements to the outside. After that, a resist is patterned so as to occupy portions serving as ink flow paths. Further, the top of the resist is provided with ink flow path wall members, and then ink ejection orifices are patterned. Next, the ink flow path wall members are cured and then the resultant is perforated with holes for supplying ink from the back surface side of the silicon substrate to ejection element portions. After that, the resist is removed. Thus, the ink flow paths and the ink ejection orifices are completed. Then, a recording element (chip) obtained by cutting the silicon substrate into a chip shape with a size required for the ink jet recording head is attached to a supporting member. After that, plating is conducted or a ball bump is formed on a pad in order that an electrical wiring board that supplies power from the outside of the head to the ink ejection pressure generating elements and the like are joined. Then, the electrical wiring board having a lead wiring is joined, and a lead sealing material that seals electrical connection portions is applied from above the board. The lead sealing material is required not only to seal the electrical connection portions but also not to cause peeling-off even by rubbing with, for example, a blade or wiper which is placed in a printer to clean the surface provided with the ink ejection orifices at the uppermost surface of a head substrate or by contact with paper or the like caused by a paper jam. Accordingly, the lead sealing material is preferably a high-hardness material.

Meanwhile, Japanese Patent Application Laid-Open No. H11-348290 describes a method involving joining an ink flow path wall member formed of an epoxy resin composition to a silicon substrate through a contact layer formed of a polyether amide resin in order that adhesion between the silicon substrate and the ink flow path wall member is maintained for a long time period.

However, a lead sealing material applied to an electrical connection portion of an ink jet recording head formed by the method described in Japanese Patent Application Laid-Open No. H11-348290 may become in contact with an interfacial portion between the ink flow path wall member and the contact layer. As the lead sealing material is typically heat-curable, the lead sealing material penetrates the interface between the ink flow path wall member and the contact layer when heating for curing is performed, and as a result, the ink flow path wall member peels off in some cases. This is probably because of the following reason. In general, the ink flow path wall member and the lead sealing material are each formed of an epoxy resin composition, and hence have close solubility parameter values (SP values). That is, the above-mentioned penetration occurs probably because an affinity between the ink flow path wall member and the lead sealing material is higher than an affinity between the ink flow path wall member and the contact layer.

SUMMARY OF THE INVENTION

In view of the foregoing, an object of the present invention is to provide a liquid ejection head, which has solved the above-mentioned problem, and is sealed with a high-hardness, high-reliability lead sealing material.

The present invention, which achieves the above-mentioned object, provides a liquid ejection head including a chip having a liquid ejection pressure generating element and an electrode terminal for electrically connecting the liquid ejection pressure generating element to the outside, an electrical wiring board having a lead wiring to be electrically connected to the electrode terminal; and a lead sealing material for covering an electrical connection portion between the electrode terminal and the lead wiring, in which the lead sealing material contains an epoxy resin (a) which has an average number of functional groups per molecule of more than two and is solid at 25° C., an acid anhydride curing agent (b) having a polybutadiene backbone, a curing accelerator (c), and an inorganic filler (d).

Further, the present invention provides a method of producing the liquid ejection head, the method including applying a lead sealing material to an electrical connection portion between an electrode terminal and a lead wiring to allow the lead sealing material to move around a periphery of the lead wiring.

According to the present invention, the liquid ejection head, which is sealed with a high-hardness, high-reliability lead sealing material is provided.

Further features of the present invention will become apparent from the following description of exemplary embodiments with reference to the attached drawings.

DESCRIPTION OF THE EMBODIMENTS

The step of sealing a liquid ejection head according to the present invention is described with reference to drawings.

Figure 1:
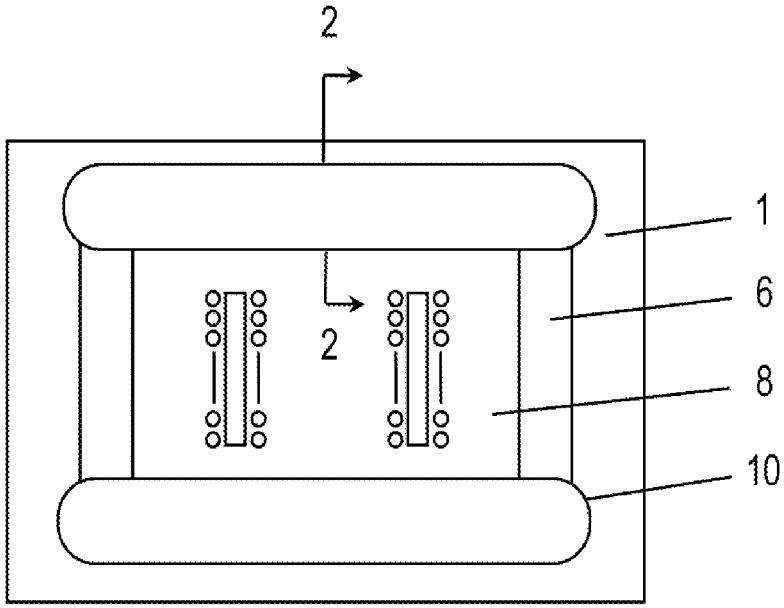
FIG. 1 is a schematic top view illustrating an example of the structure of an ink jet recording head according to the present invention.

FIG. 1 illustrates an example of the configuration of an ink jet recording head as the liquid ejection head according to the present invention. FIGS. 2A to 2E illustrate an example of a production process for the ink jet recording head as the liquid ejection head according to the present invention in a section 2-2 in FIG. 1.

Figure 2A:
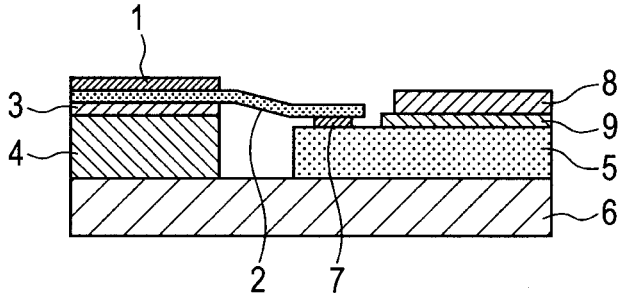
FIG. 2A is a schematic sectional view illustrating an example of a production process for the ink jet recording head according to the present invention.

As illustrated in FIG. 2A, a support 6 holds a chip formed of a silicon substrate 5, an ink flow path wall member 8 serving as a liquid flow path wall member, and a contact layer 9 arranged between the substrate and the member. Formed on the silicon substrate 5 are a liquid ejection pressure generating element and a bump 7 serving as an electrode terminal for electrically connecting the liquid ejection pressure generating element to the outside. In addition, a supporting member 4 integrated with the support 6 holds an electrical wiring board. The electrical wiring board is a laminate comprised of a lead wiring 2, and an electrical wiring board base film 1 and an electrical wiring board cover film 3 for protecting the lead wiring 2, provided that at a connection portion between the bump 7 and the lead wiring 2, the electrical wiring board base film 1 and the electrical wiring board cover film 3 are not provided, and the lead wiring 2 is electrically connected in an exposed state to the bump 7.

Figure 2B:
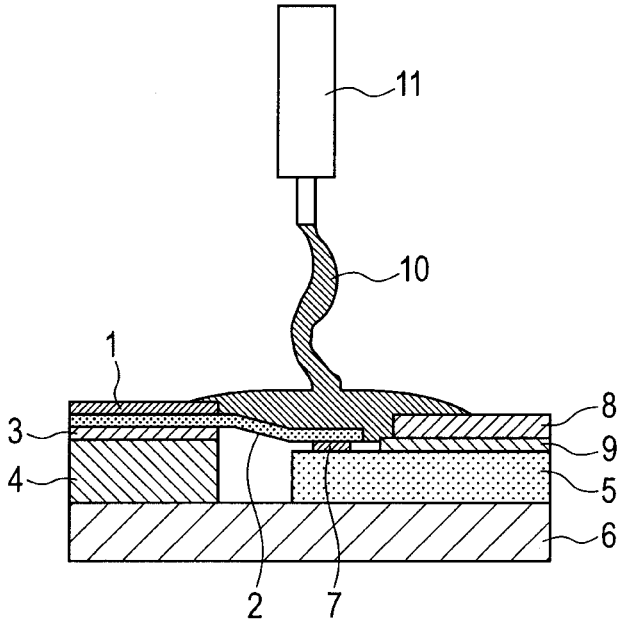
FIG. 2B is a schematic sectional view illustrating an example of the production process for the ink jet recording head according to the present invention.
Figure 2C:
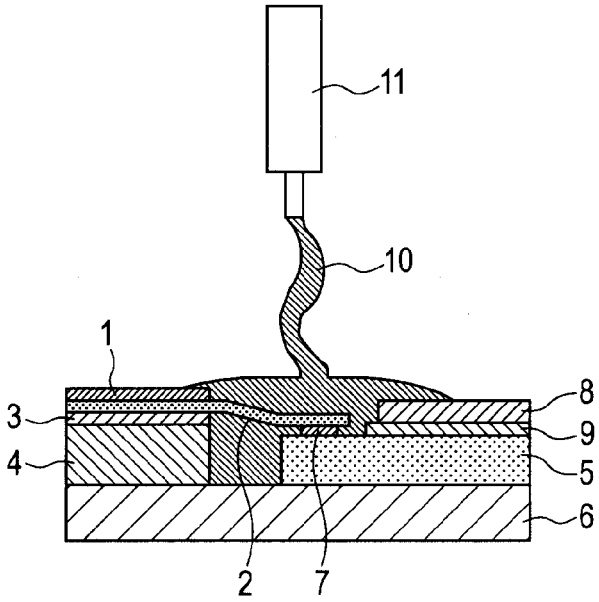
FIG. 2C is a schematic sectional view illustrating an example of the production process for the ink jet recording head according to the present invention.
Figure 2D:
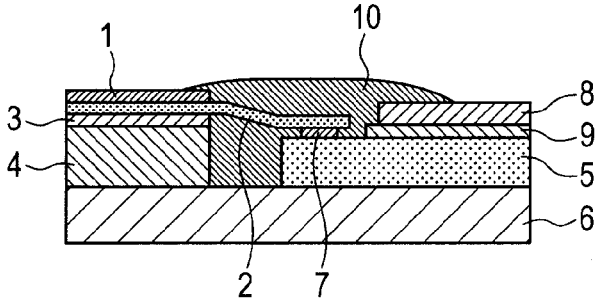
FIG. 2D is a schematic sectional view illustrating an example of the production process for the ink jet recording head according to the present invention.

In this state, as illustrated in FIG. 2B, a lead sealing material 10 is applied from a dispenser 11 placed above the electrical connection portion between the bump 7 and the lead wiring 2 so as to cover the portion. After that, as illustrated in FIG. 2C, part of the applied lead sealing material 10 moves around the periphery of the lead wiring 2. Thus, both the upper and lower portions of the lead wiring 2 are each brought into such a state that they are sealed with the lead sealing material 10. After that, heating is performed to advance the heat curing of the lead sealing material 10. As a result, as illustrated in FIG. 2D, an ink jet recording head in which the electrical connection portion between the bump 7 and the lead wiring 2 is sealed with the lead sealing material 10 is completed.

Figure 2E:
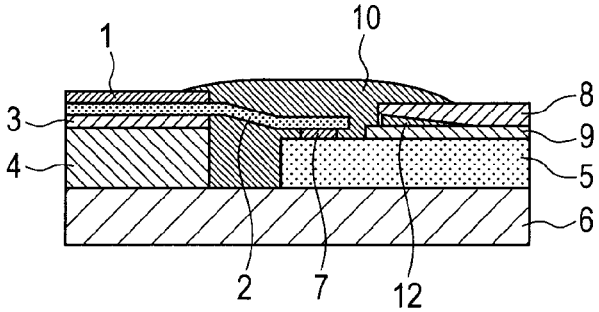
FIG. 2E is a schematic sectional view illustrating an example of the production process for the ink jet recording head according to the present invention.

Here, the lead sealing material 10 may come into contact with part of an interface between the ink flow path wall member 8 and the contact layer 9. Since the lead sealing material 10 is typically heat-curable, as illustrated in FIG. 2E, penetration 12 of the lead sealing material 10 into the interface between the ink flow path wall member 8 and the contact layer 9 is observed when heating for curing is performed, and as a result, the ink flow path wall member 8 peels off in some cases. However, the lead sealing material 10 used in the present invention hardly penetrates the interface between the ink flow path wall member 8 and the contact layer 9, and hence the ink jet recording head sealed with the lead sealing material 10 having high hardness and high reliability is obtained.

The ink flow path wall member is generally formed of an epoxy resin composition (x) containing an epoxy resin (x1) and a photoacid generator (x2). Any one of the various conventionally known epoxy resins can be used as the epoxy resin (x1). Examples of the resins include a bisphenol A-type epoxy resin, a bisphenol F-type epoxy resin, a bisphenol S-type epoxy resin, and an alicyclic epoxy resin. An aromatic iodonium salt, an aromatic sulfonium salt, or the like can be used as the photoacid generator (x2). The photoacid generator (x2) is preferably blended in an amount of 0.1 to 10 parts by weight with respect to 100 parts by weight of the epoxy resin (x1) from the viewpoint of patterning. The epoxy resin composition (x) generally has an SP value of 19 to 22 $(J/cm^3)^{1/2}$.

The contact layer is generally formed of a polyether amide resin (y). The polyether amide resin (y) generally has an SP value of 19 to 23 $(J/cm^3)^{1/2}$.

The lead sealing material contains an epoxy resin (a) which has an average number of functional groups per molecule of more than two and is solid at normal temperature. The phrase "solid at normal temperature" as used herein means that the resin is solid at 25° C. Although the average number of functional groups per molecule of the epoxy resin (a) is not particularly limited as long as the number is larger than two, the number is preferably three or more from the viewpoint of high modulus of elasticity of a cured product. When the average number of functional groups is smaller than two, it becomes difficult to sufficiently cure the lead sealing material.

A novolac-type epoxy resin, a dicyclopentadiene-type epoxy resin, or the like can be used as the epoxy resin (a). Specific examples of the novolac-type epoxy resin include epoxy resins represented by the following formula (a1). Specific examples of the dicyclopentadiene-type epoxy resin include epoxy resins represented by the following formula (a2). Of those, an epoxy resin represented by the following formula (a1) is preferably used from the viewpoint of a high modulus of elasticity of the cured product.

(a1)

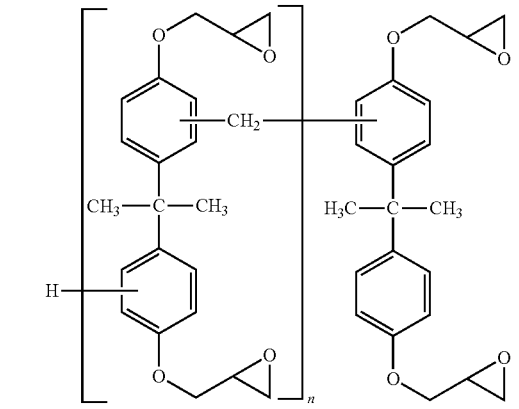

$n = 1 \sim 10$ (a2)

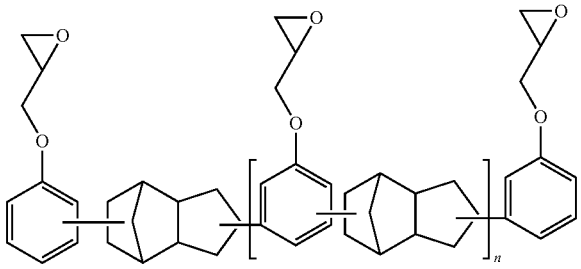

$n = 1 \sim 5$

The use of the epoxy resin (a) increases a crosslinking density, and hence a high-hardness lead sealing material can be obtained. As a result, the lead sealing material hardly peels off even by rubbing with, for example, a blade or wiper for cleaning a surface provided with ink ejection orifices at the uppermost surface of a head substrate or by contact with paper or the like caused by a paper jam. In addition, the epoxy resin (a) is solid at normal temperature, and hence hardly penetrates the interface between the ink flow path wall member and the contact layer alone.

The lead sealing material may contain any other epoxy resin (e) for the purposes of, for example, an improvement in adhesiveness, the adjustment of a viscosity, and the adjustment of reactivity. An epoxy resin which has an average number of functional groups of more than two and is liquid at normal temperature, an epoxy resin which has an average number of functional groups of two and is solid or liquid at normal temperature, an epoxy resin which has an average number of functional groups of less than two and is liquid at normal temperature, or the like can be used as the other epoxy resin (e). Specific examples of the epoxy resin which has an average number of functional groups of more than two and is liquid at normal temperature include a phenol novolac-type epoxy resin and pentaerythritol polyglycidyl ether. The epoxy resin which has an average number of functional groups of two and is solid at normal temperature is specifically, for example, a biphenyl-type epoxy resin. Specific examples of the epoxy resin which has an average number of functional groups of two and is liquid at normal temperature include a bisphenol A-type epoxy resin, a bisphenol F-type epoxy resin, and polyethylene glycol diglycidyl ether.

It should be noted that the epoxy resin which has an average number of functional groups of less than two and is liquid at normal temperature is preferably used because the resin needs to be brought into a liquid state at normal temperature in consideration of its use in the lead sealing material. In particular, a monofunctional epoxy resin (e1) represented by the following formula (e11) or the following formula (e12) is preferably used. The epoxy resin (a) which has an average number of functional groups per molecule of more than two and is solid at normal temperature can be dissolved in the monofunctional epoxy resin (e1) at normal temperature.

(e11)

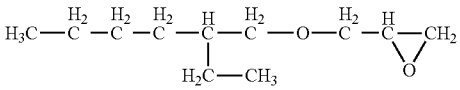

(e12)

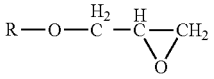

R: A mixture of $C_{11}$, $C_{13}$ and $C_{15}$ hydrocarbon groups

Any such monofunctional epoxy resin (e1) preferably has a viscosity as low as about 0.1 to 100 mPa·s at normal temperature. In addition, the SP value of any such monofunctional epoxy resin (e1) calculated by Small's prediction method is close to 17 $(J/cm^3)^{1/2}$. The monofunctional epoxy resin (e1) hardly penetrates the interface between the ink flow path wall member and the contact layer alone because such SP value is lower than that of the epoxy resin composition generally used in the ink flow path wall member or of the polyether amide resin generally used in the contact layer.

The blending ratio of the respective epoxy resin components is not particularly limited, and has only to be appropriately determined as desired. The epoxy resin (a) is preferably blended in an amount in the range of 25 to 40 parts by weight with respect to 100 parts by weight of the total of the epoxy resins in the lead sealing material.

The lead sealing material contains an acid anhydride curing agent (b) having a polybutadiene backbone. The acid anhydride curing agent (b) has only to have a structure obtained by polymerizing 1,4-butadiene or 1,2-butadiene and an acid anhydride structure, and for example, an acid anhydride curing agent obtained by introducing a maleic anhydride structure into the backbone of polybutadiene can be used. Specific examples of the acid anhydride curing agent (b) include acid anhydride curing agents represented by the following formula (b1) or (b2). Of those, an acid anhydride curing agent represented by the following formula (b1) is preferably used from the viewpoint of a high modulus of elasticity of the cured product.

(b1)

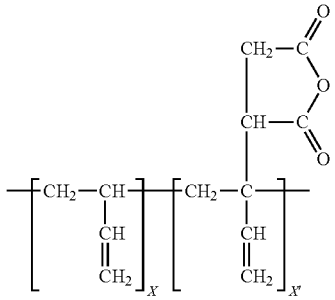

$X' = 1\sim2, X + X' = 17\sim24$ (b2)

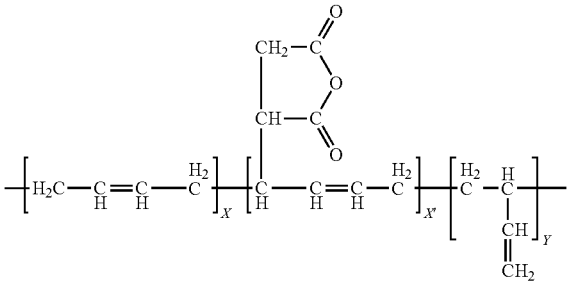

$X' = 1\sim12, Y = 2\sim12, X + X' + Y = 10\sim30$

The SP value of the acid anhydride curing agent (b) calculated by Small's prediction method is close to 15 $(J/cm^3)^{1/2}$. The acid anhydride curing agent (b) hardly penetrates the interface between the ink flow path wall member and the contact layer alone because such SP value is lower than that of the epoxy resin composition generally used in the ink flow path wall member or of the polyether amide resin generally used in the contact layer. In addition, the acid anhydride curing agent (b) has an acid anhydride equivalent of about 500 to 2,000 while a general-purpose acid anhydride curing agent has an acid anhydride equivalent of about 200 or less. Accordingly, the equivalent ratio of the acid anhydride curing agent (b) to the epoxy resins increases, and the proportion of the acid anhydride curing agent (b) blended into the lead sealing material also increases. Therefore, the SP value of the lead sealing material reduces. As a result, the affinity of the lead sealing material for the epoxy resin generally used in the ink flow path wall member or for the polyether amide resin generally used in the contact layer reduces, and hence the lead sealing material hardly penetrates the interface between the ink flow path wall member and the contact layer.

The blending amount of the acid anhydride curing agent (b) is not particularly limited, and preferably falls within the range of 100 to 125 parts by weight with respect to 100 parts by weight of the total of the epoxy resins in the lead sealing material.

The lead sealing material may contain any other curing agent (f) for the purposes of, for example, an improvement in adhesiveness, the adjustment of a viscosity, and the adjustment of reactivity. Examples of the other curing agent (f) include acid anhydride curing agents having no polybutadiene backbone, such as dodecylsuccinic anhydride (DDSA) and methylhexahydrophthalic anhydride (MeHHPA); polyamines; and amides.

The lead sealing material contains a curing accelerator (c). As the curing accelerator (c), there can be used tertiary amines such as benzyldimethylamine, tris(dimethylaminomethyl)phenol, and DBU; quaternary phosphonium salts such as tetrahydrophosphonium bromide; quaternary ammonium salts; imidazole compounds such as 2-ethyl-4-methylimidazole and 1-benzyl-2-phenylimidazole; and latent curing catalysts such as imidazole-based adducts. Of those, an imidazole-based adduct is preferably used from the viewpoints of low-temperature curability and a long pot life. The blending amount of the curing accelerator (c) is not particularly limited but is preferably 1 to 50 parts by weight with respect to 100 parts by weight of the total of the epoxy resins.

The lead sealing material contains an inorganic filler (d). Silica, aluminum nitride, or the like can be used as the inorganic filler (d). Of those, silica is preferably used from the viewpoint of ink resistance. The blending amount of the inorganic filler (d) is not particularly limited but preferably falls within the range of 500 to 1000 parts by weight with respect to 100 parts by weight of the total of the epoxy resins in the lead sealing material.

The lead sealing material may contain alcohols, phenols, a silane coupling agent, oxetane, vinyl ether, and the like for the purposes of, for example, an improvement in adhesiveness, the adjustment of a viscosity, and the adjustment of reactivity. In addition, the curing agent has a butadiene backbone, and hence when the lead sealing material contains an antiaging agent that has been generally used, it effectively functions to suppress oxidation degradation. As a result, the long-term reliability of the liquid ejection head can be improved. For example, a "NOCRAC TNP" and a "NOCRAC NS-6" (each of which is a trade name and manufactured by OUCHI SHINKO CHEMICAL INDUSTRIAL CO., LTD.) can each be used as the antiaging agent.

Hereinafter, the present invention is described more specifically by way of examples.

In Examples 1 to 10 and Comparative Examples 1 to 5, sealing resin compositions each prepared according to the formulation shown in Table 1 were provided as lead sealing materials, and were each evaluated for the following items. It should be noted that numbers shown in Table 1 represent weight ratios and the total of epoxy resins serving as main components was set to 100 parts by weight. Table 1 collectively shows the results of the respective evaluations.

Evaluation for modulus of elasticity:

2 g of each composition was put on a reaction dish made of tetrafluoroethylene, and then heated with an oven at 100° C. for 1 hour to be cured. Then, the modulus of elasticity of the resultant cured product was measured. The measurement was performed with a nanoindenter (manufactured by Fischer Instruments Co.).

Evaluation Criteria

AA: The modulus of elasticity is 1 GPa or more.

A: The modulus of elasticity is 500 MPa or more and less than 1 GPa.

B: The modulus of elasticity is less than 500 MPa.

Evaluation for low-temperature curability:

2 g of each composition was put on a reaction dish made of tetrafluoroethylene, and then heated with an oven at 100° C. for 1 hour to be cured. Then, the resultant product was evaluated for tack (tackiness) by finger feel.

Evaluation Criteria

A: Tack is absent.

B: Tack is present.

Evaluation for presence or absence of penetration into interface between ink flow path wall member and contact layer:

A chip for an ink jet recording head was produced by the following method. First, a polyether amide resin (manufactured by Hitachi Chemical Company, Ltd., trade name: HIMAL-1200) serving as a contact layer was formed on the front surface of a silicon substrate. Further, a mold occupying a portion serving as an ink flow path was provided, and then the following resin composition (1) or (2) for forming an ink flow path wall was applied onto the mold. Then, the resultant was baked with a hot plate at 80° C. for 3 minutes. Thus, a resin layer having a thickness of 80 μm was formed. Next, patterning was performed with an MPA1500 (trade name, manufactured by Canon Inc.). Thus, an ink flow path wall member serving also as an ejection orifice member was formed. Next, an ink supply orifice passing through from the back surface side of the silicon substrate toward the front surface was formed. After that, the mold occupying the portion serving as an ink flow path was removed, and then the silicon substrate was cut into a chip shape with a size required for an ink jet recording head. Thus, the chip for an ink jet recording head was obtained.

<Resin Composition (1) for Forming Ink Flow Path Wall>

Epoxy resin (manufactured by Daicel Chemical Industries Limited., trade name: EHPE-3150): 100 parts by weight Photoacid generator (manufactured by ADEKA CORPORATION, trade name: Adekaoptomer SP-170): 2 parts by weight <Resin Composition (2) for Forming Ink Flow Path Wall>

Epoxy resin (manufactured by Shell Chemicals, trade name: SU-8): 100 parts by weight Photoacid generator (manufactured by ADEKA CORPORATION, trade name: Adekaoptomer SP-170): 2 parts by weight Each of the sealing resin compositions of Examples 1 to 10 and Comparative Examples 1 to 5 was applied to an interfacial portion between the contact layer and the ink flow path wall member on the chip, and was then cured with an oven at 100° C. for 1 hour. After that, the interfacial portion was observed.

Evaluation Criteria

A: The penetration of the sealing resin composition into the interface between the ink flow path wall member and the contact layer is not observed.

B: The penetration of the sealing resin composition into the interface between the ink flow path wall member and the contact layer is observed.

TABLE 1

| | | | Example | | | | | | | |
|---|---|---|---|---|---|---|---|---|---|---|
| | | | 1 | 2 | 3 | 4 | 5 | 6 | 7 | 8 |
| Epoxy resin | Average number of functional groups > 2, solid at normal temperature | 157S70 | 33 | 25 | 40 | 33 | 33 | | | |
| | | 157S65 | | | | | | 33 | | |
| | | HP7200H | | | | | | | 33 | |
| | | HP7200HH | | | | | | | | 33 |
| | Average number of functional | EX411 | | | | | | | | |

TABLE 1-continued

| | | | | | | | | | | |
|---|---|---|---|---|---|---|---|---|---|---|
| | groups > 2, liquid at normal temperature | | | | | | | | | |
| | Average number of functional groups = 2, solid at normal temperature | YX4000 | | | | | | | | |
| | Average number of functional groups = 2, liquid at normal temperature | EX841 | | | | | | | | |
| | Average number of functional groups < 2, liquid at normal temperature | EX121<br>EX192 | 67 | 75 | 60 | 67 | 67 | 67 | 67 | 67 |
| Acid anhydride curing agent | With polybutadiene backbone | BN1015<br>Ricon131MA17 | 113 | 113 | 113 | 100 | 125 | 115 | 113 | 115 |
| | Without polybutadiene backbone | HN5500 | | | | | | | | |
| Curing accelerator | Imidazole-based adduct | PN23 | 7 | 7 | 7 | 7 | 7 | 7 | 7 | 7 |
| Inorganic filler | Silica | FB940 | 800 | 800 | 800 | 800 | 800 | 800 | 800 | 800 |
| Results of evaluations | Modulus of elasticity | | AA | AA | AA | AA | AA | AA | AA | AA |
| | Low-temperature curability | | A | A | A | A | A | A | A | A |
| | Penetration of sealing resin composition | Ink flow path wall member: resin composition (1) | A | A | A | A | A | A | A | A |
| | | Ink flow path wall member: resin composition (2) | A | A | A | A | A | A | A | A |

| | | | Example | | Comparative Example | | | | |
|---|---|---|---|---|---|---|---|---|---|
| | | | 9 | 10 | 1 | 2 | 3 | 4 | 5 |
| Epoxy resin | Average number of functional groups > 2, solid at normal temperature | 157S70<br>157S65<br>HP7200H<br>HP7200HH | 33 | 33 | | | | 33 | 33 |
| | Average number of functional groups > 2, liquid at normal temperature | EX411 | | | 33 | | | | |
| | Average number of functional groups = 2, solid at normal temperature | YX4000 | | | | 33 | | | |
| | Average number of functional groups = 2, liquid at normal temperature | EX841 | | | | | 33 | | |
| | Average number of functional groups < 2, liquid at normal temperature | EX121<br>EX192 | 67 | 67 | 67 | 67 | 67 | 67 | 67 |
| Acid anhydride curing agent | With polybutadiene backbone | BN1015<br>Ricon131MA17 | 113 | 110 | 113 | 113 | 200 | | 113 |
| | Without polybutadiene backbone | HN5500 | | | | | | 37 | |
| Curing accelerator | Imidazole-based adduct | PN23 | 7 | 7 | 7 | 7 | 7 | 7 | |
| Inorganic filler | Silica | FB940 | 800 | 800 | 800 | 800 | 800 | 800 | 800 |
| Results of evaluations | Modulus of elasticity | | AA | AA | AA | B | B | AA | B |
| | Low-temperature curability | | A | A | A | A | B | A | B |
| | Penetration of sealing resin composition | Ink flow path wall member: resin composition (1) | A | A | B | A | B | B | A |
| | | Ink flow path wall member: resin composition (2) | A | A | B | A | B | B | A |

"157S70": trade name, manufactured by Japan Epoxy Resins Co., Ltd., novolac-type epoxy resin represented by the formula (a1), average number of functional groups: 8

"157S65": trade name, manufactured by Japan Epoxy Resins Co., Ltd., novolac-type epoxy resin represented by the formula (a1), average number of functional groups: 8

"HP7200H": trade name, manufactured by DIC Corporation, dicyclopentadiene-type epoxy resin represented by the formula (2a), average number of functional groups: 3

"HP7200HH": trade name, manufactured by DIC Corporation, dicyclopentadiene-type epoxy resin represented by the formula (2a), average number of functional groups: 3

"EX411": trade name, manufactured by Nagase ChemteX Corporation, pentaerythritol polyglycidyl ether, average number of functional groups: 4, viscosity: 800 mPa·s (25° C.)

"YX4000" trade name, manufactured by Japan Epoxy Resins Co., Ltd., biphenyl-type epoxy resin, average number of functional groups: 2

"EX841": trade name, manufactured by Nagase ChemteX Corporation, polyethylene glycol diglycidyl ether, average number of functional groups: 2, viscosity: 110 mPa·s (25° C.)

"EX121": trade name, manufactured by Nagase ChemteX Corporation, 2-ethylhexyl glycidyl ether represented by the formula (e11), average number of functional groups: 1, viscosity: 4 mPa·s (25° C.)

"EX192": trade name, manufactured by Nagase ChemteX Corporation, glycidyl ether mixture represented by the formula (e12), average number of functional groups: 1, viscosity: 8 mPa·s (25° C.)

"BN1015": trade name, manufactured by Nippon Soda Co., Ltd., acid anhydride curing agent represented by the formula (b1)

"Ricon131MA17": trade name, manufactured by Sartomer Company, Inc., acid anhydride curing agent represented by the formula (b2)

"HN5500": trade name, manufactured by Hitachi Kasei Kogyo Co., Ltd., methylhexahydrophthalic anhydride "PN23": trade name, manufactured by Ajinomoto Fine-Techno Co., Inc.

"FB940": trade name, manufactured by DENKI KAGAKU KOGYO KABUSHIKI KAISHA

As can be seen from the results of Table 1, in each of the ink jet recording heads produced in Examples 1 to 10, the sealing resin composition had a high modulus of elasticity, and penetration into the interface between the ink flow path wall member and the contact layer was not observed. It is supposed that these two features were simultaneously achieved because the epoxy resin (a) which had an average number of functional groups per molecule of more than two and was solid at normal temperature was used as a main component and the acid anhydride curing agent (b) having a polybutadiene backbone was used in each of Examples 1 to 10.

In contrast, in each of the ink jet recording heads produced in Comparative Examples 1 to 3 in each of which an epoxy resin which was liquid at normal temperature or an epoxy resin having an average number of functional groups per molecule of two or less was used, the sealing resin composition had a low modulus of elasticity, or penetration into the interface between the ink flow path wall member and the contact layer was observed. In Comparative Example 4, a general-purpose acid anhydride curing agent was used, and its SP value was close to 20 $(J/cm^3)^{1/2}$. Accordingly, the penetration into the interface between the ink flow path wall member and the contact layer occurred. In Comparative Example 5, no curing accelerator was used. Accordingly, curing at 100° C. for 1 hour hardly led to an increase in crosslink density, and hence the modulus of elasticity was low.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-110103, filed May 12, 2010, which is hereby incorporated by reference herein in its entirety.

What is claimed is:

1. A liquid ejection head, comprising:

a chip having a liquid ejection pressure generating element and an electrode terminal for electrically connecting the liquid ejection pressure generating element to an external source;

an electrical wiring board having a lead wiring to be electrically connected to the electrode terminal; and a lead sealing material for covering an electrical connection portion between the electrode terminal and the lead wiring, wherein the lead sealing material contains (a) an epoxy resin which has an average number of functional groups per molecule of more than two and is solid at 25° C., (b) an acid anhydride curing agent having a polybutadiene backbone, (c) a curing accelerator, and (d) an inorganic filler.

2. A liquid ejection head according to claim 1, wherein the chip comprises:

a silicon substrate on which the liquid ejection pressure generating element and the electrode terminal have been formed, a liquid flow path wall member, and a contact layer arranged between the silicon substrate and the liquid flow path wall member; and wherein the lead sealing material is in contact with part of an interface between the liquid flow path wall member and the contact layer.

3. A liquid ejection head according to claim 1, wherein the epoxy resin is represented by the following formula (a1), and the acid anhydride curing agent is represented by the following formula (b1):

(a1)

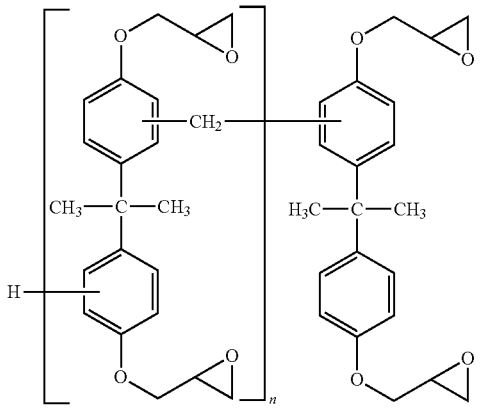

$n = 1 \sim 10$ (b1)

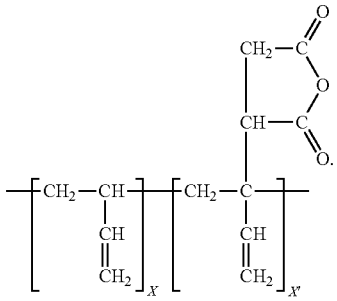

$X' = 1 \sim 2,\ X + X' = 17 \sim 24$

4. A method of producing the liquid ejection head according to claim 1, the method comprising applying the lead sealing material to the electrical connection portion between the electrode terminal and the lead wiring to allow the lead sealing material to move around a periphery of the lead wiring.

5. A liquid ejection head according to claim 2, wherein the liquid flow path wall member is formed of an epoxy resin composition, and the contact layer is formed of a polyether amide resin.

* * * * *